US006282921B1

(12) United States Patent
Carter

(10) Patent No.: US 6,282,921 B1
(45) **Date of Patent: *Sep. 4, 2001**

(54) EAR DECORATION

(76) Inventor: Mary J. Carter, 315 Surrey Dr., Bonita, CA (US) 91902

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/151,046

(22) Filed: Sep. 10, 1998

(51) Int. Cl.[7] ..... A44C 7/00

(52) U.S. Cl. ..... 63/12; 63/13; 63/14.1; 63/14.2; 63/14.8

(58) Field of Search ..... 63/1.18, 12, 13, 63/14.1, 14.2, 14.8

(56) References Cited

U.S. PATENT DOCUMENTS

| | | | | |
|---|---|---|---|---|
| 20,480 | * | 6/1858 | Carpenter | 3/14.2 |
| 528,197 | * | 10/1894 | Woglom | 63/12 |
| 2,040,083 | * | 5/1936 | Elliott et al. | 63/14.2 |
| 2,410,914 | * | 11/1946 | Williams | 63/14.2 |
| 2,414,382 | * | 1/1947 | McCann | 63/14.2 |
| 2,502,386 | * | 3/1950 | Mailand | 63/14.2 |
| 2,511,170 | * | 6/1950 | McCann | 63/14.2 |
| 2,525,195 | * | 10/1950 | Austrin et al. | 63/14.2 |
| 2,526,087 | * | 10/1950 | Schoolman et al. | 63/14.2 |
| 2,542,730 | * | 2/1951 | Thronsen | 63/14.2 |
| 2,610,486 | * | 9/1952 | McCann | 63/14.2 |
| 2,764,000 | * | 9/1956 | Lippmann | 63/14.2 |
| 2,823,525 | * | 2/1958 | Crigler | 63/14.1 |
| 3,053,061 | * | 9/1962 | French | 63/14.1 |
| 4,704,878 | * | 11/1987 | Saraga | 63/14.1 |
| 4,724,684 | * | 2/1988 | Barnett | 63/14.1 |
| 4,827,738 | * | 5/1989 | Rothal | 63/14.1 |
| 5,184,482 | * | 2/1993 | Cloud | 63/12 X |
| 5,809,803 | * | 9/1998 | Stracuzzi | 63/12 |
| 5,964,105 | * | 10/1999 | Nakamura | 63/14.1 |

FOREIGN PATENT DOCUMENTS

| | | | | |
|---|---|---|---|---|
| 947523 | * | 8/1956 | (DE) | 63/14.1 |
| 960133 | * | 3/1957 | (DE) | 63/14.1 |

* cited by examiner

*Primary Examiner*—B. Dayoan
*Assistant Examiner*—Andrea Chop
(74) *Attorney, Agent, or Firm*—Foley & Lardner; Bernard L. Kleinke

(57) ABSTRACT

The ear decoration includes a supporting portion, a securing portion and a generally U-shaped connecting portion connected between the supporting portion and securing portion to grip an ear therebetween. A bracing portion spaced apart from the securing portion limits the displacement of the ear decoration for helping to prevent the ear decoration from becoming dislodged from the ear.

13 Claims, 3 Drawing Sheets

EAR DECORATION

TECHNICAL FIELD

The present invention relates in general to an improved ear decoration and a method of making it. The invention more particularly relates to an ear decoration which may be worn comfortably and securely, and which can be made according to a novel method.

BACKGROUND ART

There have been many types of earrings for decorating the ear of the user. For example, reference may be made to the following U.S. Pat. Nos. 20,480; 2,040,083; 2,542,743; 2,764,000; 4,704,878; and 4,724,684.

U.S. Pat. Nos. 20,480, 2,040,083, 2,642,730, and 2,764,000 all disclose earrings having opposing members that are urged towards one another, wherein the earring is secured on the ear by squeezing a portion of the ear therebetween. U.S. Pat. No. 20,480 discloses an earring having a pair of wires biased towards one another by a spring. The wire members may be moved apart from one another to enable the earring to be placed on the ear. Once on the ear, the spring is permitted to urge the two wires towards one another to squeeze an ear portion therebetween.

U.S. Pat. Nos. 2,040,083, 2,542,730, and 2,764,000 each disclose an earring having an engaging member for engaging the pinna from the front of the ear, and an opposing set screw member for engaging the pinna from the rear to adjustably pinch the ear between the set screw member and the engaging member.

While such earrings may have been satisfactory for securing the earrings to the ear of the wearer, the pinching of the ear by the earring was uncomfortable for the wearer. The discomfort was particularly acute when the earrings were worn for a substantial length of time.

Earrings which may be worn on an ear without pinching the ear are described in U.S. Pat. Nos. 4,704,878 and 4,724,684. Disclosed therein are earrings having an open loop member with mounting members at both ends thereof. The open loop member was curved to position the mounting members at specific angles relative to one another and on opposite sides of the ear, wherein one of the mounting members could be disposed inside of the ear while the other mounting member was disposed on the back outer portion of the ear when the earring was in place. The curvature of the open loop member combined with the placement of the mounting members enabled the earrings to be worn without pinching the ear and causing discomfort.

Although such earrings facilitated the wearing of the earrings without pinching the ears and causing discomfort, the earrings were subject to swaying away from the head of the wearer when the head was moved or tilted. As a result, the earrings were subject to being displaced from the ear, and were thus susceptible to being dislodged from the ear and lost.

Therefore, it would be highly desirable to have a new and improved ear decoration, which can be readily and comfortably worn on an ear. Such an earring should be resistant to dislodgment from the ear while being worn, and relatively inexpensive to manufacture.

SUMMARY OF THE INVENTION

Therefore, the principal object of the present invention is to provide a new and improved ear decoration and a method of making it, wherein the ear decoration is worn comfortably and securely, and is relatively inexpensive to manufacture.

Briefly, the above and further objects of the present invention are realized by providing a new and improved ear decoration which is worn comfortably and securely and is made according to a novel method of the present invention.

The ear decoration includes a supporting portion, a securing portion and a generally U-shaped connecting portion connected between the supporting portion and securing portion to grip an ear therebetween. A bracing portion spaced apart from the securing portion limits the displacement of the ear decoration for helping to prevent the ear decoration from becoming dislodged from the ear.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
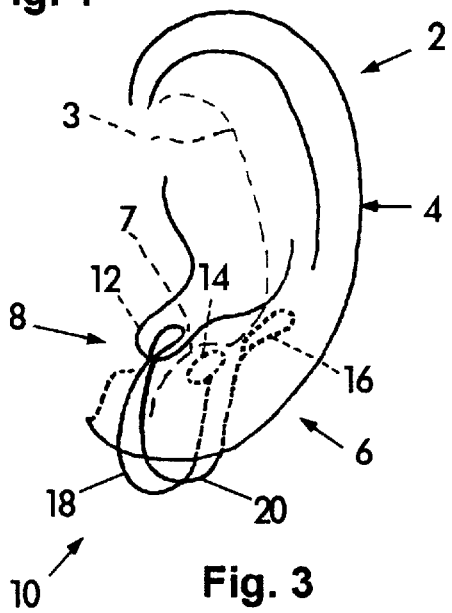
FIG. 1 is a side view of an ear having an ear decoration in place thereon, which ear decoration is constructed in accordance with the present invention.
Figure 2:
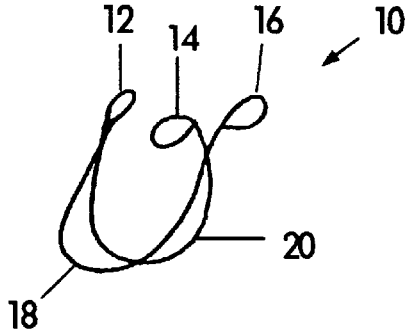
FIG. 2 is a side view of the ear decoration of FIG. 1.

Referring now to the drawings, and more particularly to FIGS. 1 and 2 thereof, there is shown an ear decoration 10, which is constructed in accordance with the present invention. The decoration 10 can be worn comfortably, and can be made according to the method of the present invention. The decoration 10 is adapted for use on an ear 2 having a pinna 4, a lobe 6 and an intertragic notch 8.

The decoration 10 generally includes a supporting portion 12 adapted to be received within the intertragic notch 8 for supporting the decoration 10 from the ear 2. A securing portion 14 engages the ear 2 from behind the lobe 6 at about a slight depression 7 located near the intersection of the head (not shown), pinna 4 and lobe 6. The intersection is shown generally at line 3 (FIG. 1).

A generally U-shaped open loop connecting member 20 is disposed between the supporting portion 12 and the securing portion 14. The connecting member 20 generally encloses the lobe 6 between the supporting portion 12 and the securing portion 14 when the decoration 10 is placed on the ear 2.

The connecting member 20 defines a gap between the supporting portion 12 and the securing portion 14 to facilitate placing the decoration 10 on the ear, wherein the decoration 10 is positioned on the ear 2 with the supporting portion 12 and the securing portion 14 on opposite sides of the lobe 6. Preferably, the supporting portion 12 and the securing portion 14 do not press into or pinch the ear 2. The connecting member 20 merely holds the supporting portion 12 and the securing portion 14 sufficiently in engagement with the ear 2 to grip it securely.

The contours of the ear 2 help retain the decoration 10 in place on the ear 2 by limiting the movement of the supporting portion 12 and the securing portion 14. In this regard, the positioning of the supporting portion 12 in the intertragic notch 8 limits the movement of the supporting portion 12 while the positioning of the securing member 14 in the depressed area 7 limits the movement of the securing portion 14.

The decoration 10 further includes a bracing portion 16 connected to the supporting portion 12 by generally U-shaped open loop connecting member 18. The bracing portion 16 is spaced apart from the securing portion 14 to engage the ear 2 from behind the pinna 4, and above the depression 7, for substantially limiting the movement of the decoration 10 relative to the ear 2 and away from the head. In particular, the bracing portion 16 substantially prevents the decoration 10 from rotating about the ear 2 during physical activities, such as bending or tilting of the head. Such rotation, if not prevented, could enable the supporting portion 12 to become disengaged from the intertragic notch 8, wherein the decoration 10 would be susceptible to becoming dislodged from the ear 2. Thus, the bracing portion 16 substantially prevents the decoration 10 from becoming dislodged inadvertently from the ear 2.

The decoration 10 is preferably constructed from a single continuous wire element, wherein the element is reversely bent at about a central portion thereof to define the supporting portion 12. The portions of the element on either side of the reversely bent supporting portion are bent or otherwise formed to define the U-shaped connecting members 18 and 20. The distal ends of the connecting members 20 and 18 are bent into closed loops to define the securing portion 14 and the bracing portion 16, respectively.

The singular continuous element comprising the decoration 10 comprises a substantially flexible material, such as metal wire, to enable the decoration to be adapted to the ears of various wearers, and to enable the decoration 10 to be light in weight. The continuous element may also be rigid to enable the supporting portion 12 to be moved away from the securing portion 14 and the bracing portion 16 to facilitate placing the decoration 10 on the ear 2, and to enable the supporting portion 12 to be urged toward the securing portion 14 and the bracing portion 16 after the decoration 10 is in place.

Although in the preferred embodiment the decoration 10 is constructed from a single continuous element, the supporting portion 12, the securing portion 14, the bracing portion 16 and the connecting members 18 and 20 can be comprised of discrete elements connected to one another by adhesives, soldering or other means.

It will be understood by one skilled on the art that the decoration 10 is suitable for use with either a right or left ear, such as the left ear 2 shown in FIG. 1.

Figure 3:
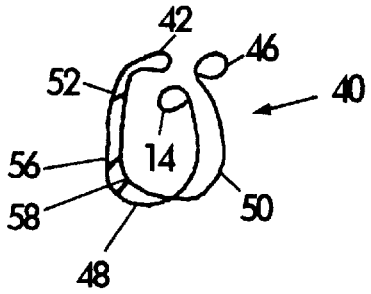
FIG. 3 is a side view of another ear decoration, which is also constructed in accordance with the present invention.

Referring now to FIG. 3, there shown another ear decoration 40 which is substantially similar to the decoration 10 (FIGS. 1 and 2). The decoration 40 includes a supporting portion 42, a securing portion 44, a bracing portion 46 and connecting members 48 and 50. The decoration 40 further includes cross-members 54, 56 and 58 secured between the connecting members 48 and 50 to limit the displacement of the connecting member 50 relative to the connecting member 48 for increasing the strength and stability of the device 40.

Figure 4:
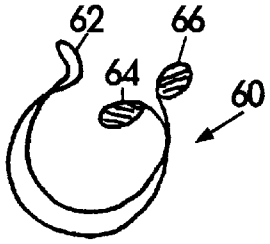
FIG. 4 is a side view of another ear decoration, which is also constructed in accordance with the present invention.

Referring now to FIG. 4, there is shown another ear decoration 60 which is substantially similar to the ear decoration 10 (FIGS. 1 and 2). The decoration 60 includes supporting portion 62 spaced apart from securing portion 64 and bracing portion 66. The securing portion 64 and bracing portion 66 define ball members for increasing the area of engagement of the decoration 60 with the ear, such as the ear 2 (FIG. 1).

Figure 5:
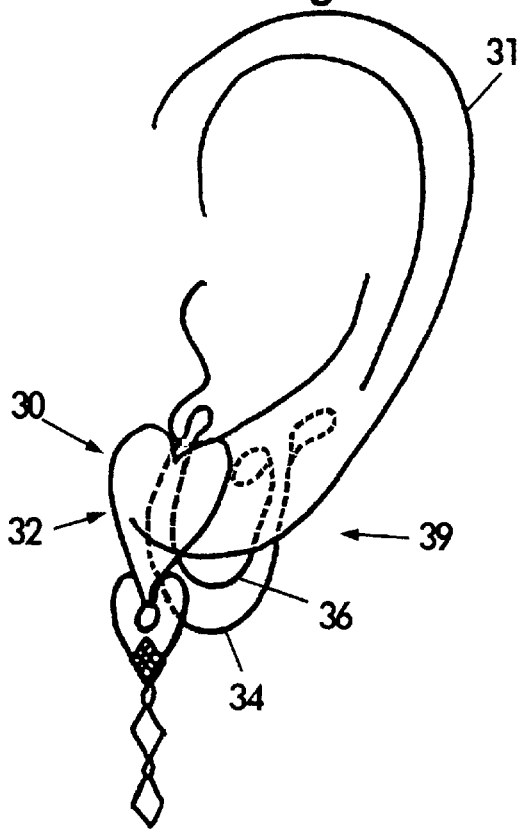
FIG. 5 is a side view of an ear with another ear decoration in place thereon, which ear decoration is also constructed in accordance with the present invention.

Referring now to FIG. 5, there is shown another ear decoration 30, which is also constructed in accordance with the present invention. The decoration 30 is substantially similar to the decoration 10 (FIGS. 1 and 2), and further includes an ornament 32 secured to connecting members 34 and 36, wherein the ornament 32 is positioned in front of a lobe portion 39 of an ear 31.

Figure 6:
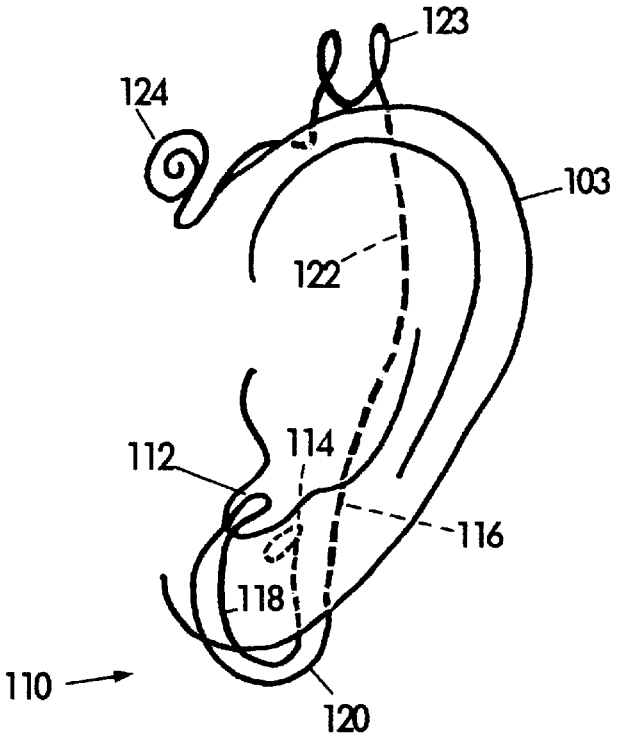
FIG. 6 is a side view of an ear with another ear decoration in place thereon, which ear decoration is also constructed in accordance with the present invention.
Figure 7:
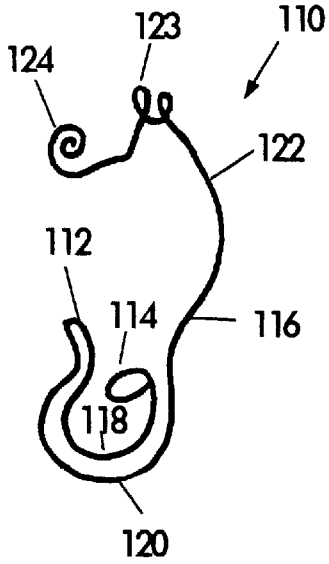
FIG. 7 is a side view of the ear decoration of FIG. 6.

Referring now to FIGS. 6 and 7, there is shown another ear decoration 110 which is also constructed in accordance with the present invention. The decoration 110 includes a supporting portion 112 for disposing within an intertragic notch of an ear 103. The decoration 110 further includes a securing portion 114 connected to the supporting portion 112 by connecting member 118, wherein the securing portion 114 cooperates with the supporting portion 112 to grip the ear 103 therebetween.

The decoration 110 further includes a U-shaped connecting member 120 extending from the supporting portion 112 and having a bracing portion 116 for engaging the ear 103 from behind. A reverse C-shaped extension member 122 extends substantially upwardly and away from the bracing portion 116. A double loop portion 123 extending from member member 122 is positioned above the ear for supporting an ornament (not shown).

As shown in FIG. 6, the extension member 122 follows the rear contour of the intersection of the head and the ear 103 and extends forwardly therefrom when the decoration 110 is placed on the ear 103. An ornamental feature 124 is disposed at a distal end of the extension member 122 to provide additional ornamentation above the ear 103.

Figure 8:
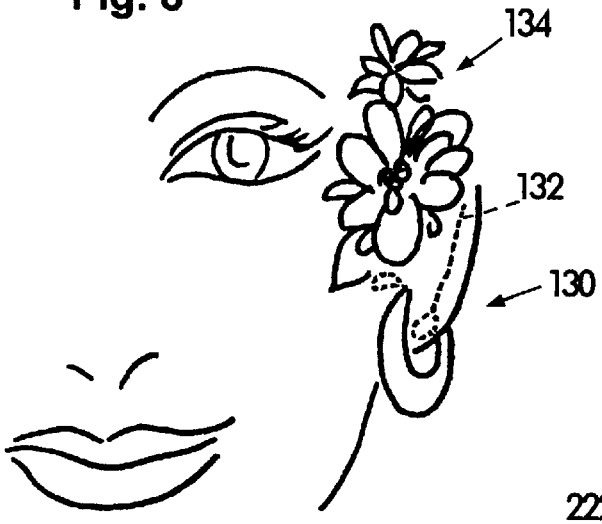
FIG. 8 is a front view of another ear decoration in place on an ear, which ear decoration is also constructed in accordance with the present invention.

Referring to FIG. 8, there is shown another ear decoration 130, which is also constructed in accordance with the present invention. The decoration 130 is substantially similar to the decoration 110, except the ornamental feature 124 (FIGS. 6 and 7) is replaced by a flowered ornamental decoration 134 to provide additional ornamentation in front of the ear.

Figure 9:
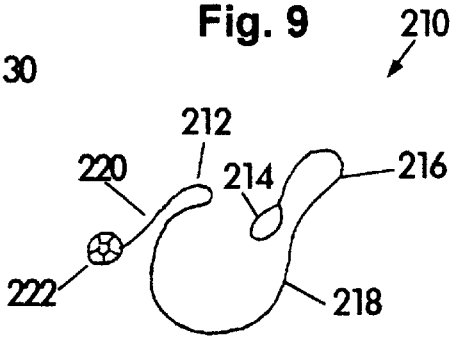
FIG. 9 is another ear decoration, which is also constructed in accordance with the present invention.

Referring now to FIG. 9, there is shown another ear decoration 210, which is also constructed in accordance with the present invention. The decoration 210 is constructed from a single continuous element to define a supporting portion 212, a securing portion 214, a bracing portion 216 and a generally U-shaped open loop connecting member 218. The element is reversely bent at about one end to define the supporting portion 212. The other end of the element is bent into a loop to define the securing portion 214. The element is reversely bent intermediate the supporting portion 212 and the securing portion 214 to define the bracing portion 216, wherein the securing portion 214 is positioned between the supporting portion 212 and the bracing portion 216.

To provide additional ornamentation, an ornament 222 is secured to an extension member 220 extending forwardly from the supporting portion 212.

Figure 10:
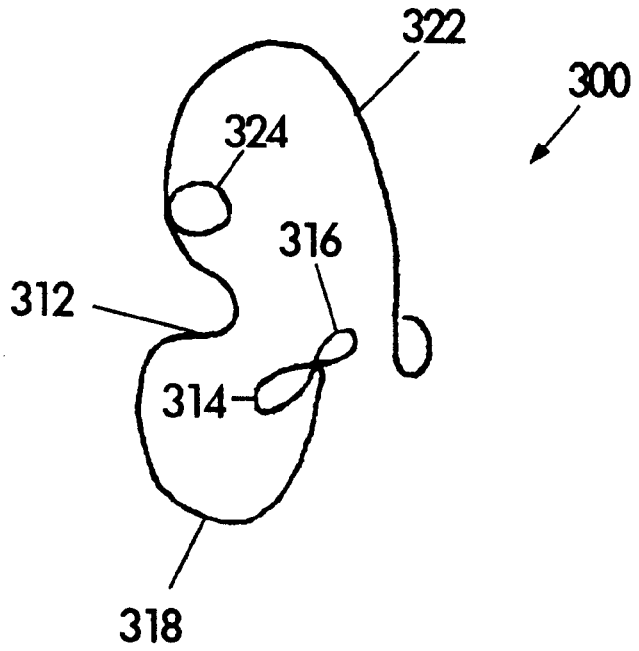
FIG. 10 is a further ear decoration, which is also constructed in accordance with the present invention.
Figure 11:
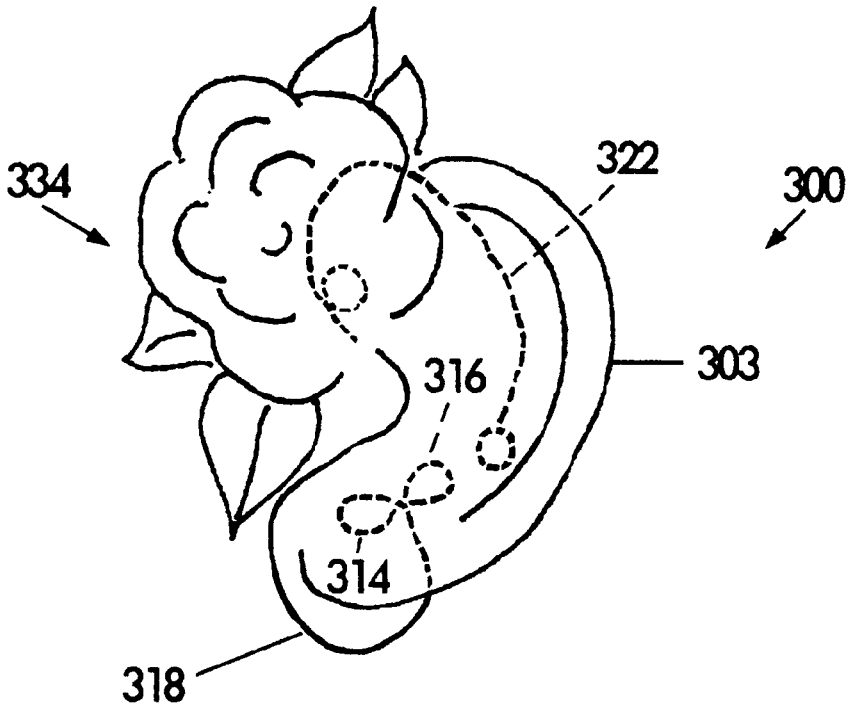
FIG. 11 is a side view of the ear decoration of FIG. 10 in place on an ear.

Referring now to FIGS. 10 and 11 there is shown a further ear decoration 300 which is also constructed in accordance with the present invention. The ear decoration 300 is substantially similar to the ear decoration 210 (FIG. 9) and includes a supporting portion 312, a securing portion 314, a bracing portion 316, and a generally U-shaped open loop connecting number 318. The ear decoration 300 further includes an arcuate extension number 322 extending away from the supporting portion 312 to further secure the decoration 300. A loop portion 324 of the extension number 322 enables an ornament 334 (FIG. 11) to be secured to the decoration 300.

As best seen in FIG. 11, the decoration 300 is supported securely on an ear 303 by the securing portion 314 and the bracing portion 316. The extension member 322 extends upwardly from the supporting portion 312 in front of the ear 303, and curves around to the back of the ear 303 to provide additional support for the ornament 334 secured to the decoration 300 at the loop portion 324 by a conventional attachment device.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An ear decoration for use with an ear having a pinna, a slight depression at the bottom of the pinna behind the ear at about the intersection of the pinna and head, and an intertragic notch at the front of the ear, comprising:

a notch-engagable supporting portion comprising a single centrally-disposed reversely-bent hook portion adapted for hooking engagement onto the ear in front of the pinna within the intertragic notch and adapted for resting on the base of the notch to support the weight of said ear decoration therefrom;

a securing portion being disposed transversely inwardly offset and below said single centrally-disposed hook portion adapted for engaging the ear at the depression to cooperate with said supporting portion to grip the ear therebetween;

a bracing portion spaced apart from the securing portion and disposed transversely outwardly offset relative to said single centrally-disposed hook portion and adapted for engaging the ear from behind the pinna to substantially limit the movement of said ear decoration relative to the ear; and a generally U-shaped connecting means for connecting said supporting portion to said securing portion and said bracing portion, said single centrally-disposed hook portion being aligned with said U-shaped connecting means and said securing portion and said bracing portion being disposed on opposite sides relative to said single centrally-disposed hook portion.

2. A decoration according to claim 1, further including an ornament affixed to said connecting means at about said supporting portion.

3. A decoration according to claim 1, wherein said supporting portion, said securing portion, said bracing portion and said connecting means are defined by a single continuous element.

4. A decoration according to claim 3, wherein said element includes a resilient wire.

5. A decoration according to claim 3, wherein said bracing portion is disposed intermediate said supporting portion and said securing portion along said element, said element being reversely bent to position said securing portion between said supporting portion and said bracing portion.

6. A decoration according to claim 5, further including an extension portion extending forwardly from said supporting portion, and an ornament affixed to said extension portion.

7. A decoration according to claim 1, wherein said connecting means includes a connecting member for connecting said supporting portion to said securing portion and another connecting member for connecting said supporting portion to said bracing portion.

8. A decoration according to claim 7, further including a cross member between said connecting member and said another connecting member to substantially limit relative movement between said connecting member and said another connecting member.

9. A decoration according to claim 7, wherein said securing portion and said bracing portion are defined by ball members at distal ends of said connecting member and said another connecting member.

10. A decoration according to claim 1, further including a reverse C-shaped extension portion extending away from said bracing portion for engaging the ear from behind the pinna and projecting forwardly from the ear, and an ornament disposed at a forwardly projecting end of said extension portion.

11. An ear decoration for use with an ear having a pinna, a slight depression at the bottom of the pinna behind the ear at about the intersection of the pinna and head, and an intertragic notch at the front of the ear, comprising:

a continuous open loop element;

said element having a notch-engagable single centrally-disposed reversely bent hook portion for defining a supporting portion adapted for hooking engagement onto the ear in front of the pinna within the intertragic notch and adapted for resting on the base of the notch to support the weight of said ear decoration therefrom;

said element further having another bent portion for defining a securing portion at one end of said continuous element at a portion and disposed transversely inwardly offset from and below said single centrally-disposed hook portion adapted for engaging the ear from behind at the depression to cooperate with said supporting portion to grip the ear therebetween;

said element further having a bracing portion spaced apart from the securing portion and disposed transversely outwardly offset relative to said single centrally-disposed hook portion and adapted for engaging the ear from behind the pinna to substantially limit the movement of said ear decoration relative to the ear; and said element further including a generally U-shaped connecting portion for connecting said supporting portion to said securing portion and said bracing portion, said single centrally-disposed hook portion being aligned with said U-shaped connecting portion and said securing portion and said bracing portion being disposed on opposite sides relative to said single centrally-disposed hook portion.

12. An ear decoration according to claim 11, further including an arcuate extension member extending from said supporting portion to provide additional support for the decoration.

13. An ear decoration according to claim 12, wherein said extension member includes a loop portion, and further including an ornament secured to said loop portion.

* * * * *